US010501228B2

(12) United States Patent
Hsu

(10) Patent No.: US 10,501,228 B2
(45) Date of Patent: Dec. 10, 2019

(54) PACKING BOX

(71) Applicant: Kinpo Electronics, Inc., New Taipei (TW)

(72) Inventor: Teng-Yun Hsu, New Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 15/990,709

(22) Filed: May 28, 2018

(65) Prior Publication Data

US 2019/0283922 A1 Sep. 19, 2019

(30) Foreign Application Priority Data

Mar. 16, 2018 (CN) ..... 2018 2 0360955 U

(51) Int. Cl.
*B65D 5/66* (2006.01)
*B65D 5/20* (2006.01)

(52) U.S. Cl.
CPC ..... *B65D 5/6655* (2013.01); *B65D 5/2057* (2013.01)

(58) Field of Classification Search
CPC .. B65D 5/6655; B65D 5/2057; B65D 5/6608; B65D 5/665; B65D 5/66; B65D 5/6602; B65D 5/6667
USPC .... 229/128, 145, 160.1, 141, 146, 148, 149, 229/150, 231, 125.26, 154; 206/268; D9/423
See application file for complete search history.

(56) References Cited

U.S. PATENT DOCUMENTS 2,881,967 A * 4/1959 Ringler ..... B65D 5/703 229/160.1
3,432,090 A * 3/1969 Engel ..... B65D 5/64 229/145
3,608,812 A * 9/1971 Hamilton ..... B65D 5/6608 229/145
4,314,643 A * 2/1982 Forbes, Jr. ..... B65D 5/548 206/807
4,846,397 A * 7/1989 Copeland ..... B65D 5/16 229/102
5,947,368 A * 9/1999 Thresher ..... B65D 5/5435 229/208
6,334,532 B1 * 1/2002 Tambo ..... B65D 85/1045 206/268

* cited by examiner

*Primary Examiner* — Christopher R Demeree
(74) *Attorney, Agent, or Firm* — JCIPRNET

(57) ABSTRACT

A packing box including a box body and a cover body is provided. The box body includes a bottom plate and first side plates connected to the bottom plate. The bottom plate and the first side plates collectively encircle an accommodation space. One of the first side plates includes a first tongue piece extending out of the accommodation space. The first tongue piece includes a fixing end and a free end. The cover body includes a top plate and a second side plate. The top plate is pivotally connected to the box body, such that the top plate is adapted to be opened or closed to expose or shield the accommodation space. The second side plate includes a first inner layer and a first outer layer stacked with each other. The first inner layer has a notch, and the notch is close to one side of the top plate and corresponds to the first tongue piece. When the cover body is closed to the box body, the free end strikes the first outer layer of the second side plate to produce a sound.

10 Claims, 14 Drawing Sheets

PACKING BOX

CROSS-REFERENCE TO RELATED APPLICATION

This application claims the priority benefit of China application serial no. 201820360955.1, filed on Mar. 16, 2018. The entirety of the above-mentioned patent application is hereby incorporated by reference herein and made a part of this specification.

BACKGROUND OF THE INVENTION

Field of the Invention

The invention relates to a packing box, and particularly relates to a packing box with a top cover adapted to be flipped over relative to a box body for open and close.

Description of Related Art

Generally, goods are placed in packing boxes when being delivered, and the packing boxes are used for protecting the goods and providing an appearance decoration. Along with increase of consumer's demand on quality of the goods, quality of the packing box is also required to be improved, however, manufacturing cost of the packing box is also increased along with increase of design complexity thereof. Therefore, how to improve the quality of the packing box without increasing its manufacturing cost is one of the targets for various manufacturers.

SUMMARY OF THE INVENTION

The invention is directed to a packing box with good quality and low cost.

The invention provides a packing box including a box body and a cover body. The box body includes a bottom plate and a plurality of first side plates connected to the bottom plate. The bottom plate and the first side plates collectively encircle an accommodation space. One of the first side plates includes a first tongue piece extending out of the accommodation space. The first tongue piece includes a fixing end and a free end opposite to each other. The fixing end of the first tongue piece is connected to one side of the first side plate away from the bottom plate. The cover body includes a top plate and a second side plate connected to the top plate. The top plate is pivotally connected to the box body, such that the top plate is adapted to be opened or closed to expose or shield the accommodation space. The second side plate includes a first inner layer and a first outer layer stacked with each other. The first inner layer has a notch, and the notch is close to one side of the top plate and corresponds to the first tongue piece. During a process that the cover body is closed to the box body, the first tongue piece of the first side plate is pushed by the first inner layer of the second side plate, and the free end is gradually approached to an outer surface of the first side plate until the free end moves into the notch and is rebounded back to an inner surface of the first outer layer.

In an embodiment of the invention, the first inner layer of the second side plate of the packing box has two slits extended from the notch, and a part of the first inner layer located between the two slits is adapted to be folded to serve as a second tongue piece.

In an embodiment of the invention, in a first phase that the cover body of the packing box is lifted up from the box body, the free end of the first tongue piece of the first side plate is moved into a space between the second tongue piece and the first outer layer, and the first tongue piece contacts to interfere the second tongue piece.

In an embodiment of the invention, in a second phase that the cover body of the packing box is lifted up from the box body, the second tongue piece is folded in a direction away from the first outer layer, and drives the free end of the first tongue piece to rotate in a direction away from the outer surface of the first side plate until leaving a moving path of the second tongue piece, so as to release the interference on the second tongue piece.

In an embodiment of the invention, a length of the slit of the first inner layer of the second side plate of the packing box is equal to a length of the first tongue piece.

In an embodiment of the invention, a width of the first tongue piece of the packing box is greater than a length of the first tongue piece.

In an embodiment of the invention, dimensions of a length and a width of the notch of the second side plate of the packing box are greater than or equal to dimensions of a length and a width of the first tongue piece, respectively.

In an embodiment of the invention, in the packing box, the first side plate having the first tongue piece includes a second inner layer and a second outer layer stacked with each other, the second inner layer has a U-shape slit, and the first tongue piece is formed by folding a part of the second inner layer surrounded by the U-shape slit towards an outer surface of the second outer layer.

In an embodiment of the invention, a shape of the notch of the second side plate of the packing box corresponds to a shape of the first tongue piece.

In an embodiment of the invention, the packing box further includes an inner separation member disposed in the accommodation space, and leaning against the first side plate having the first tongue piece.

According to the above description, in the packing box of the embodiment of the invention, the cover body is adapted to be flipped over relative to the box body for open and close, the first side plate of the box body is configured with the first tongue piece, the second side plate of the cover body has the inner layer and the outer layer stacked with each other, and the inner layer is configured with the notch corresponding to the first tongue piece. During a process of closing the cover body to the box body, the first tongue piece is first pushed by the inner layer and slightly deformed, and is then moved into the notch of the inner layer and rebounded back, such that the free end impact the part of the outer layer of the second side plate of the cover body corresponding to the notch. Since the first tongue piece is first pushed and deformed and is then rebounded back, when the first tongue piece of the box body is rebounded back to impact the cover body, a loud sound is produced, such that the user learns that the cover body has completed closing. The above sound made by the first tongue piece is similar to a sound produced by a buckling member when it is buckled. Namely, the packing box of the embodiments of the invention is unnecessary to install a buckling member but still has a quality similar to the existing packing box using the buckling member, so that effects of simplifying a production process and reducing manufacturing cost are achieved.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
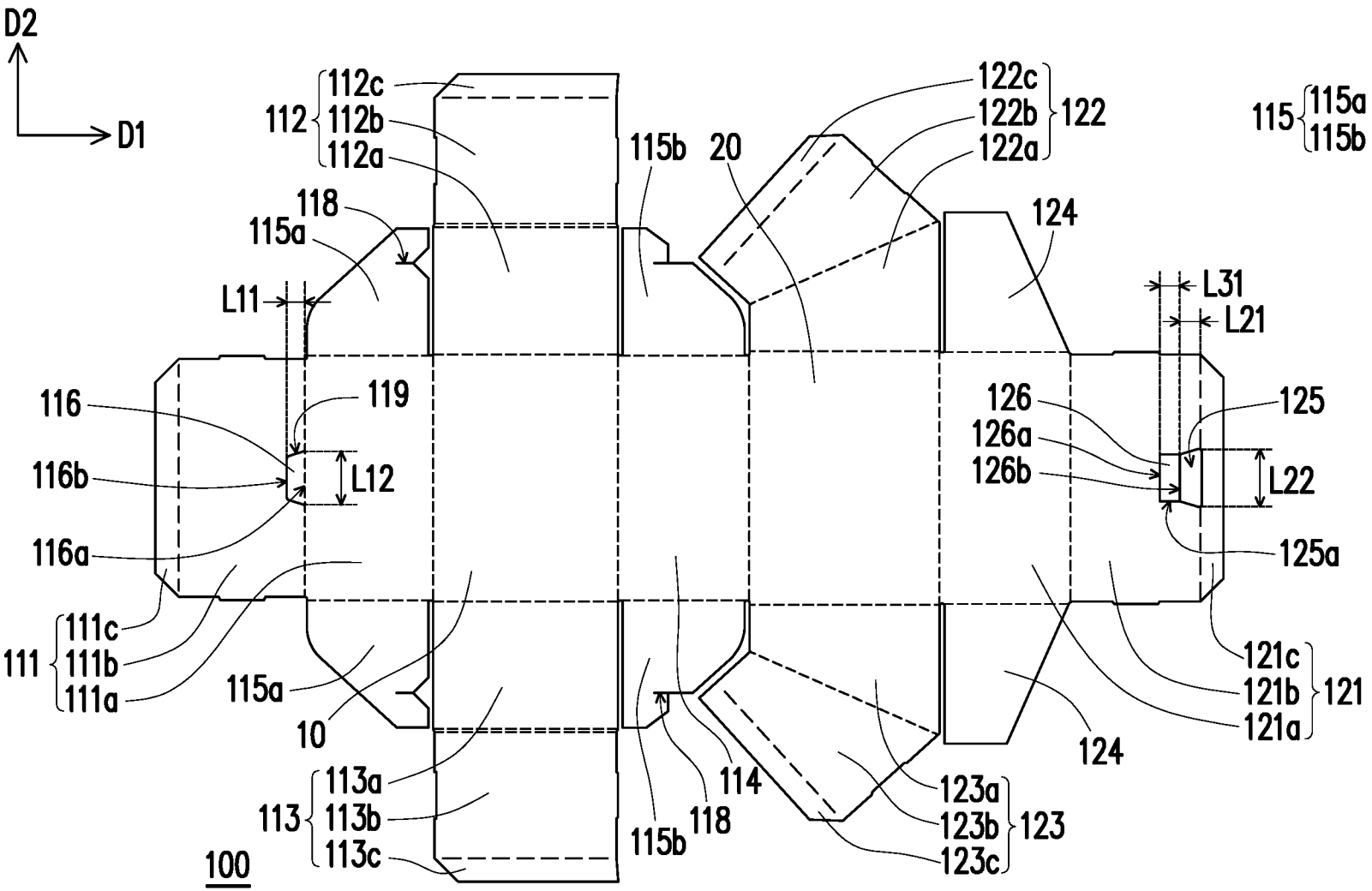
FIG. 1 is a diagram of a packing box fully spread in a plane according to an embodiment of the invention.
Figure 2A:
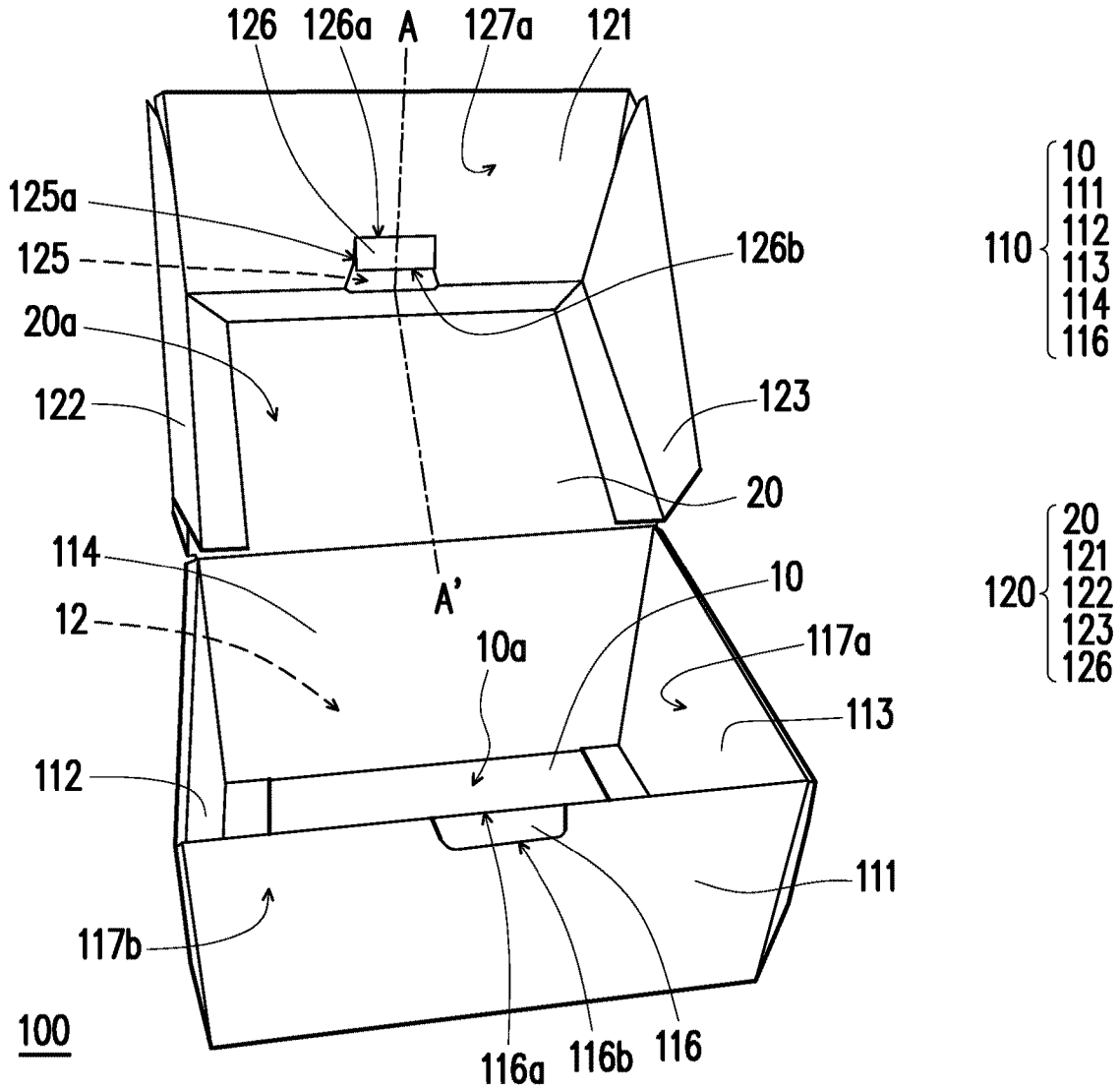
FIG. 2A is a three-dimensional view of the packing box of FIG. 1 after assembling.
Figure 2B:
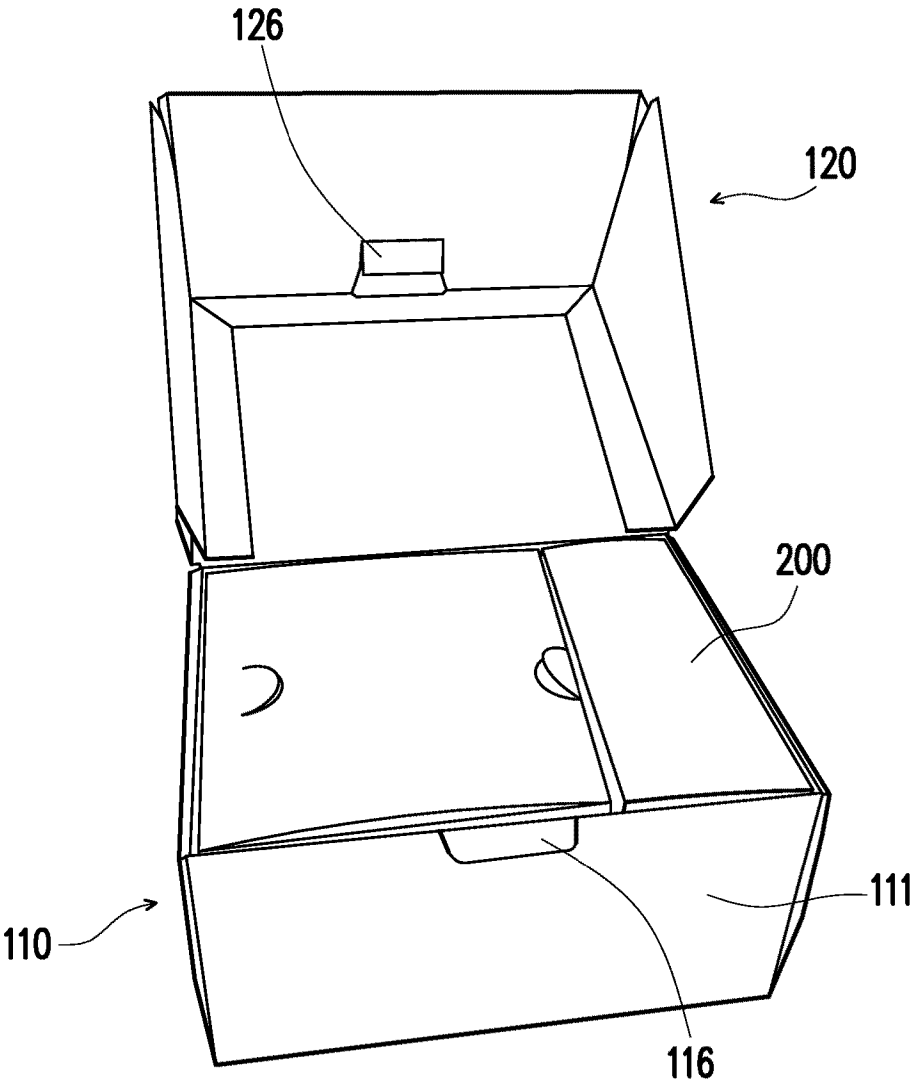
FIG. 2B is a three-dimensional view of an inner separation member configured in the packing box of FIG. 2A.

FIG. 1 is a diagram of a packing box fully spread in a plane according to an embodiment of the invention. FIG. 2A is a three-dimensional view of the packing box of FIG. 1 after assembling. FIG. 2B is a three-dimensional view of an inner separation member configured in the packing box of FIG. 2A. In the embodiment, the packing box 100 in the spread state of FIG. 1 may be folded into an assembling state shown in FIG. 2A, and then a piece of goods (not shown) or an inner separation member 200 (for example, an inner box) used for separating placing positions of goods may be put into the packing box 100 as that shown in FIG. 2B. The packing box 100 is described in detail below.

Referring to FIG. 2A, the packing box 100 of the embodiment includes a box body 110 and a cover body 120. The box body 110 includes a bottom plate 10 and a plurality of first side plates 111, 112, 113, 114 connected to the bottom plate 10, and the bottom plate 10 and the first side plates 111, 112, 113, 114 collectively encircle an accommodation space 12. The first side plate 111 includes a first tongue piece 116 extending out of the accommodation space 12, and the first tongue piece 116 includes a fixing end 116*a* connected to the first side plate 111 and a free end 116*b* located opposite to the fixing end 116*a*. In the embodiment, the fixing end 116*a* of the first tongue piece 116 is disposed on one side of the first side plate 111 away from the bottom plate 10, though the invention is not limited thereto.

Moreover, referring to FIG. 1 for detailed components of the box body 110, to be specific, in the embodiment, the first side plate 111 of the box body 110 includes a second outer layer 111*a* and a second inner layer 111*b* which can be stacked with each other. Namely, the first side plate 11 is a double layer structure. It should be noted that in the embodiment, the second inner layer 111*b* of the first side plate 111 has a U-shape slit 119, and the first tongue piece 116 is formed by folding a part of the second inner layer 111*b* surrounded by the U-shape slit 119 towards an outer surface 117*b* of the second outer layer 111*a*, though the invention is not limited thereto. In other embodiments, the first side plate 111 may also be a single layer structure, and the first tongue piece 116 may also be an element additionally attached on the first side plate 111.

Moreover, in the embodiment, the first side plate 112 includes a second outer layer 112*a* and a second inner layer 112*b* which can be stacked with each other, and the first side plate 113 includes a second outer layer 113*a* and a second inner layer 113*b* which can be stacked with each other. To be specific, in the embodiment, the first side plates 111, 112, 113 are rotatably connected to the bottom plate 10 through the second outer layers 111*a*, 112*a* and 113*a*, respectively. Namely, the first side plates 112, 113 are respectively double layer structures. Certainly, in other embodiments, the first side plate 112 and/or the first side plate 113 may also be single layer structures.

Moreover, the box body 110 further includes a plurality of first wing plates 115*a*, 115*b* having slits 118, where the two first wing plates 115*a* are rotatably connected to two opposite sides of the second outer layer 111*a*, respectively, and two first wing plates 115*b* are rotatably connected to two opposite sides of the first side plate 114, respectively. In the embodiment, the first side plates 111, 112, 113 further respectively include leaning plates 111*c*, 112*c*, 113*c*, where the leaning plates 111*c*, 112*c*, 113*c* are rotatably connected to the second inner layers 111*b*, 112*b*, 113*b*, respectively, though the invention is not limited thereto.

Referring back to FIG. 2A, in the embodiment, the cover body 120 includes a top plate 20 and a second side plate 121 connected to the top plate 20, where the top plate 20 is pivotally connected to the box body 110, such that the top plate 20 is adapted to be opened or closed to expose or shield the accommodation space 112 of the box body 110. The second side plate 121 includes a notch 125 located close to one side of the top plate 20 and corresponding to the first tongue piece 116. Referring to FIG. 1 and FIG. 2A, in the embodiment, the second side plate 121 of the cover body 120 includes a first outer layer 121*a* and a first inner layer 121*b* can be stacked with each other, and the second side plate 121 is rotatably connected to the top plate 20 via the first outer layer 121*a*. To be specific, the first inner layer 121*b* of the second side plate 121 has the notch 125.

Referring to FIG. 1, in the embodiment, the cover body 120 further includes second side plates 122 and 123, where the second side plate 122 includes a first outer layer 122*a* and a first inner layer 122*b* which can be stacked with each other, and the second side plate 123 includes a first outer layer 123*a* and a first inner layer 123*b* which can be stacked with each other, and the second side plates 122, 123 are rotatably connected to the top plate 20 via the first outer layers 122*a*, 123*a*, respectively. Moreover, in the embodiment, the second side plates 121, 122, 123 further respectively include leaning plates 121*c*, 122*c*, 123*c*, where the leaning plates 121*c*, 122*c*, 123*c* are rotatably connected to the first inner layers 121*b*, 122*b* and 123*b*, respectively. However, the invention is not limited thereto, and in another embodiment, the second side plate 122 and/or the second side plate 123 may be omitted, or the second side plate 122 and/or the second side plate 123 may be respectively a single layer structure.

Moreover, in the embodiment, the first tongue piece 116 of the first side plate 111 respectively has a length L11 and a length L12 in a first direction D1 and a second direction D2. In the embodiment, the length L12 of the first tongue piece 116 in the second direction D2 is greater than the length L11 in the first direction D1, though the invention is not limited thereto. Moreover, in the embodiment, a shape of the notch 125 of the second side plate 121 corresponds to a shape of the first tongue piece 116 of the first side plate 111, and the shapes are all trapezoids, though the invention is not limited thereto. The notch 125 of the second side plate 121 respectively have a length L21 and a length L22 in the first direction D1 and the second direction D2, the length L22 of the notch 125 in the second direction D2 is greater than the length L21 in the first direction D1. Moreover, in the embodiment, the lengths L21 and L22 of the notch 125 of the second side plate 121 are respectively greater than the lengths L11 and L12 of the first tongue piece 116 of the first side plate 111. However, the invention is not limited thereto, and in another embodiment, the lengths L21 and L22 of the notch 125 of the second side plate 121 are respectively equal to the lengths L11 and L12 of the first tongue piece 116 of the first side plate 111.

Then, an assembling method of the packing box 100 of the embodiment is described below. It should be noted that only one assembling order is introduced below, and the invention is not limited thereto. Referring to FIG. 1 and FIG. 2A, first, the two first wing plates 115*a* are folded towards an inner surface 117*a* of the second outer layer 111*a* of the first side plate 111, and the two first wing plates 115*b* are folded towards the inner surface 117*a* of the first side plate 114. Then, the second outer layer 111*a* of the first side plate 111 and the first side plate 114 are folded towards the bottom plate 10 of the box body 110, such that the two first wing plates 115*a* are respectively clamped to the corresponding two first wing plates 115*b* to form two connection portions 115. To be specific, the first wing plates 115*a* and the first wing plates 115*b* are clamped to each other via the slits 118.

Then, the second outer layers 112*a*, 113*a* are folded towards the bottom plate 10 to positions contacting the connection portions 115, and the second inner layers 112*b*, 113*b* rotatably connected to the second outer layer 112*a*, 113*a* are folded towards the inner surface 117*a* of the second outer layers 112*a*, 113*a*, such that the first side plate 112 wraps the connection portion 115 through the second outer layer 112*a* and the second inner layer 112*b*, and the first side plate 113 wraps the connection portion 115 through the second outer layer 113*a* and the second inner layer 113*b*. Then, the leaning plates 112*c*, 113*c* are respectively folded towards the inner surface 117*a* of the second inner layers 112*b*, 113*b*, while the second inner layers 112*b*, 113*b* are respectively moved closer to the second outer layers 112*a*, 113*a*, such that the leaning plates 112*c*, 113*c* are flatly attached to an inner surface 10*a* of the bottom plate 10, in this case, the two first side plates 112, 113 respectively and stably stand on two opposite sides of the bottom plate 10.

Moreover, the second inner layer 111*b* of the first side plate 111 is folded towards the inner surface 117*a* of the second outer layer 111*a*, and the leaning plate 111*c* is folded towards the inner surface 117*a* of the second inner layer 111*b*, while the second inner layer 111*b* is moved closer to the second outer layer 111*a*, such that the leaning plates 111*c* is flatly attached to the inner surface 10*a* of the bottom plate 10, in this case, the first side plates 111 may stably stand on side of the bottom plate 10 opposite to the first side plate 114. In this way, the first side plates 111, 112, 113, 114 and the bottom plate 10 of the box body 110 construct the accommodation space 12. Moreover, a part of the second inner layer 111*b* surrounded by the U-shape slit 119 is folded towards the outer surface 117*b* of the second outer layer 111*a* to form the first tongue piece 116.

Then, two wing plates 124 rotatably connected to two opposite sides of the first outer layer 121*a* are folded towards an inner surface 127*a* of the first outer layer 121*a*, and the first outer layers 121*a*, 122*a*, 123*a* of the second side plates 121, 122, 123 are respectively folded towards an inner surface 20*a* of the top plate 20, such that the first outer layers 122*a*, 123*a* are respectively overlapped to the two second wing plates 124. Then, the first inner layers 122*b*, 123*b* rotatably connected to the first outer layer 122*a*, 123*a* are folded towards the inner surface 127*a* of the first outer layers 122*a*, 123*a*, such that the second side plate 122 wraps the second wing plate 124 through the first outer layer 122*a* and the first inner layer 122*b*, and the second side plate 123 wraps the second wing plate 124 through the first outer layer 123*a* and the first inner layer 123*b*. Then, the leaning plates 122*c*, 123*c* are respectively folded towards the inner surface 127*a* of the first inner layers 122*b*, 123*b*, while the first inner layers 122*b*, 123*b* are respectively moved closer to the first outer layers 122*a*, 123*a*, such that the leaning plates 122*c*, 123*c* are flatly attached to the inner surface 10*a* of the bottom plate 10, in this case, the two second side plates 122, 123 respectively and stably stand on two opposite sides of the top plate 20.

It should be noted that in the present embodiment, the first inner layer 121*b* of the second side plate 121 further includes two slits 125*a* extended from the notch 125, and the part of the first inner layer 121*b* located between the two slits 125*a* is adapted to be folded to serve as a second tongue piece 126, and a length L31 of the two slits 125*a* in the first direction D1 is equal to the length L11 of the first tongue piece 116 in the first direction D1, though the invention is not limited thereto.

Then, the first inner layer 121*b* rotatably connected to the first outer layer 121*a* is folded towards the inner surface 127*a* of the first outer layer 121*a*, and the leaning plate 121*c* is folded towards the inner surface 127*a* of the first inner layer 121*b*, while the first inner layer 121*b* is moved closer to the first outer layer 121*a*, such that the leaning plate 121*c* is flatly attached to the inner surface 20*a* of the top plate 20, in this case, the second side plate 121 may stably stand on one side of the top plate 20. At this point, assembling of the box body 110 and the cover body 120 of the packing box 100 is completed. It should be noted that during the process of assembling the packing box 100 of the embodiment, no adhesion is required, so that a production flow is simplified and manufacturing cost is saved.

Figure 3:
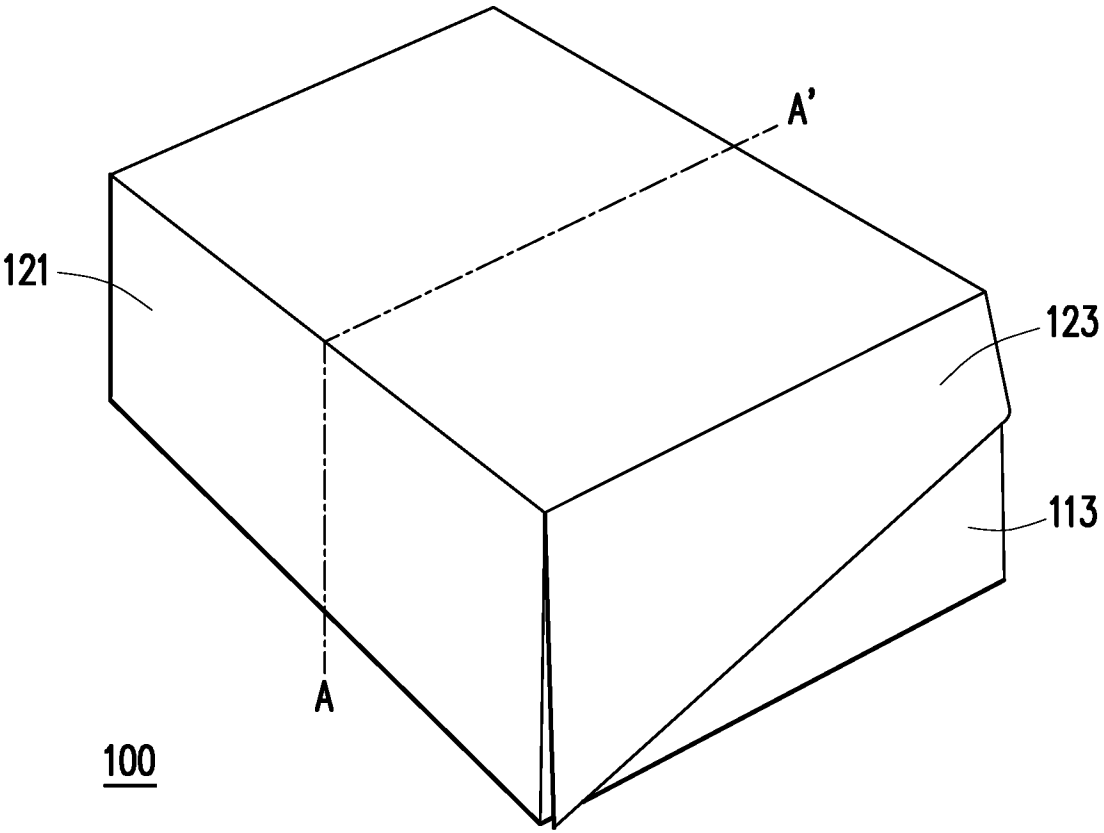
FIG. 3 is a three-dimensional view of the packing box of FIG. 2A when a cover body is closed to a box body.
Figure 4A:
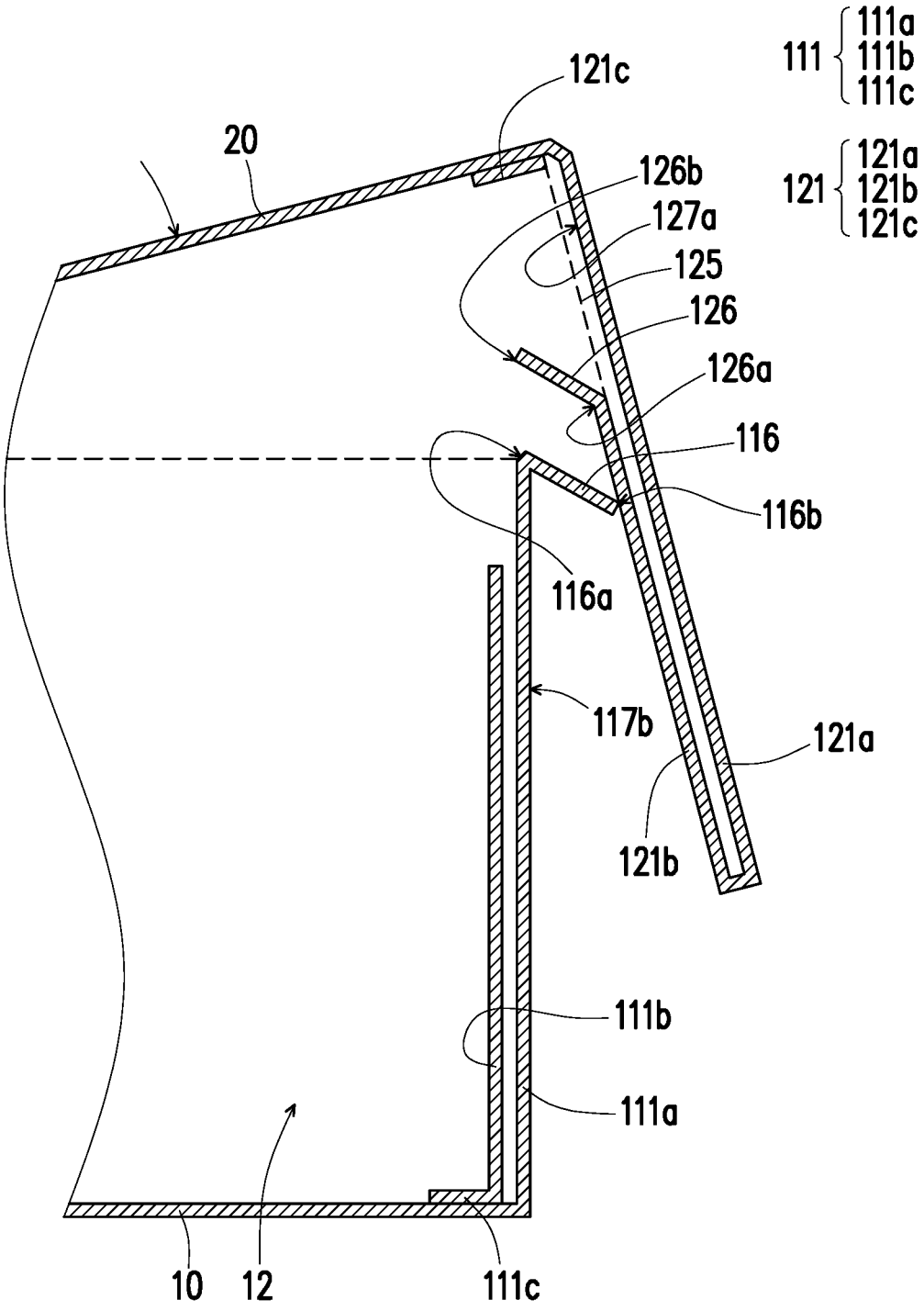
FIG. 4A to FIG. 4D are cross-sectional views of a closing process of a cover body of the packing box of FIG. 2A along a section line A-A'.
Figure 4B:
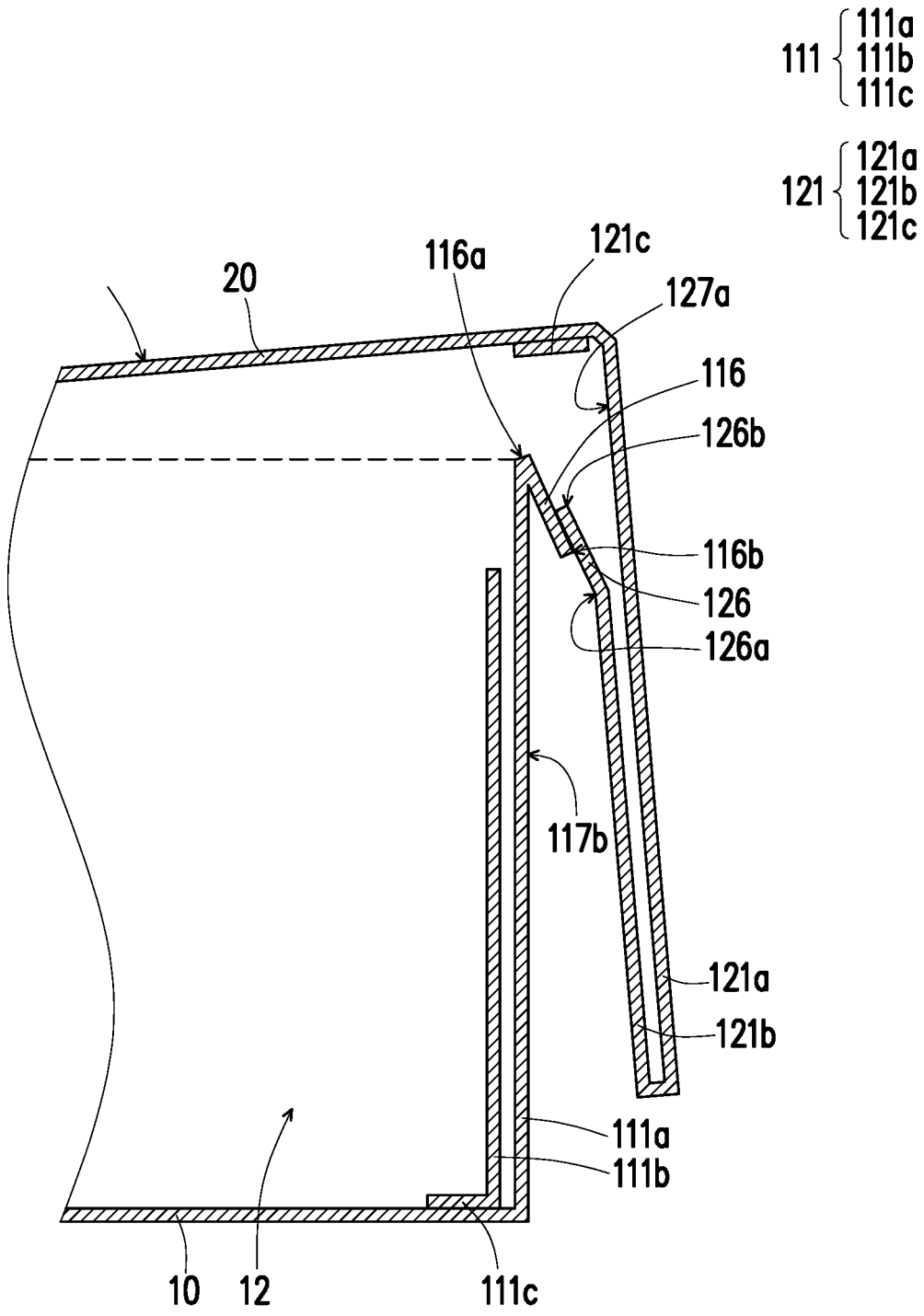
Figure 4C:
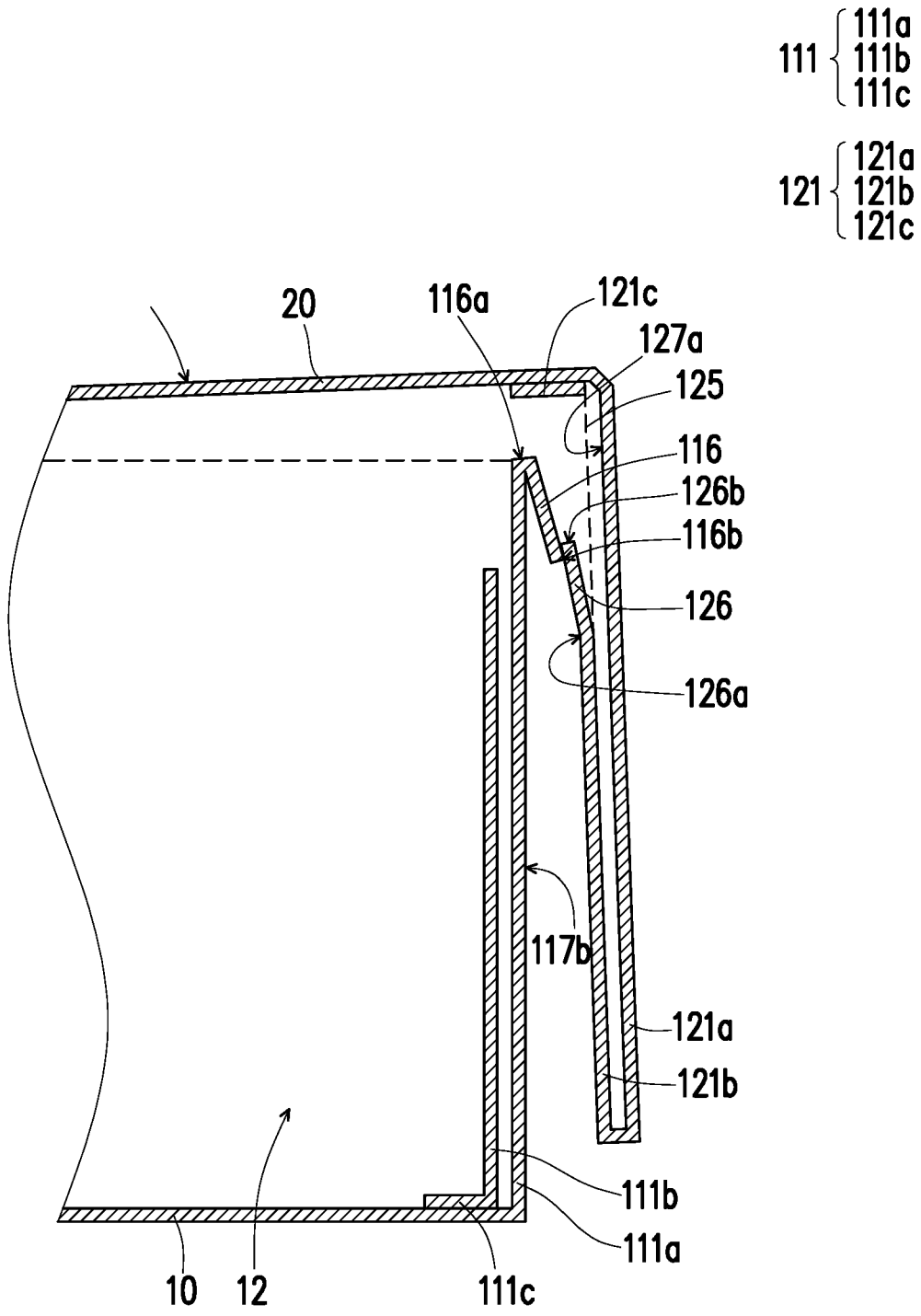
Figure 4D:
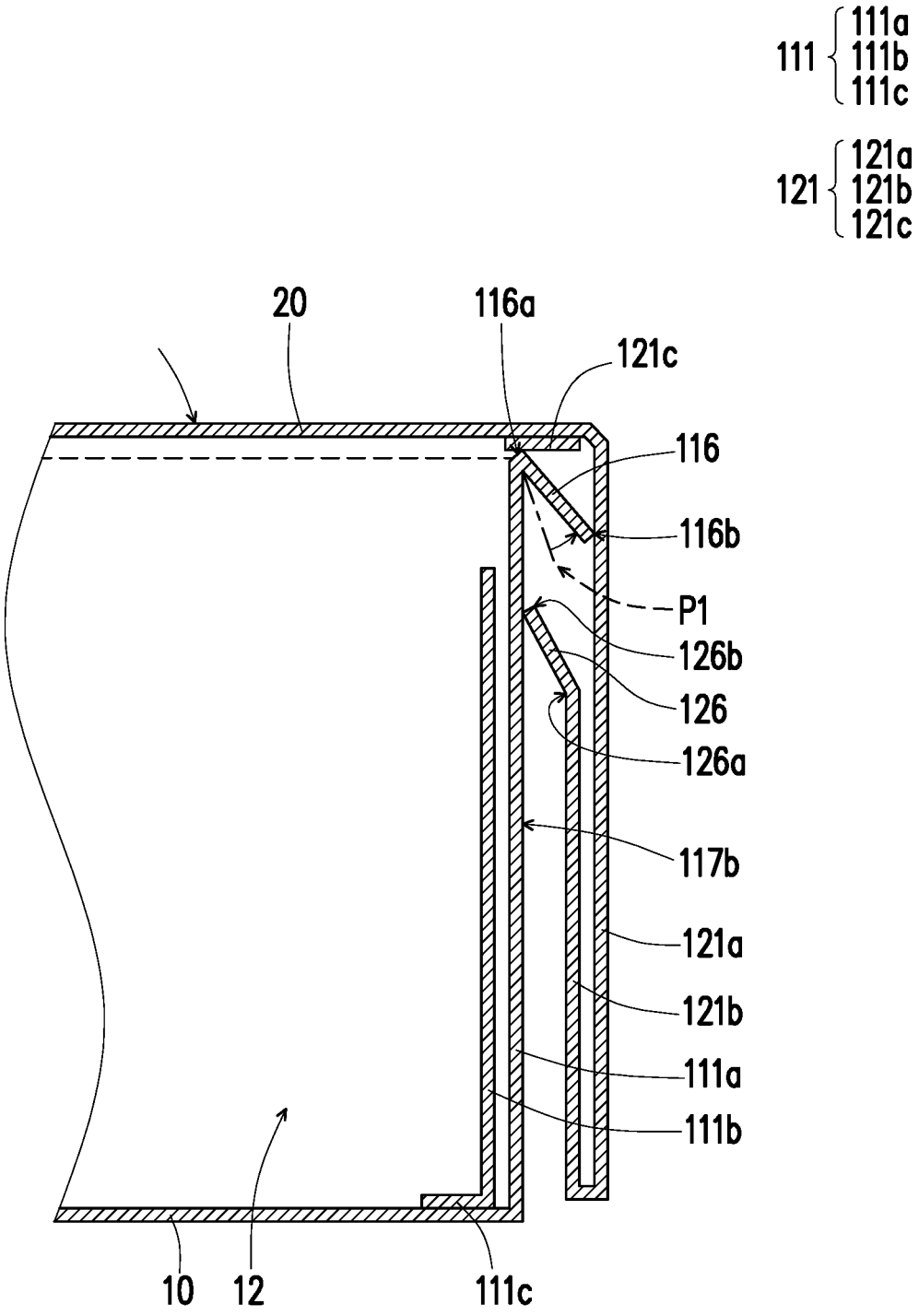

FIG. 3 is a three-dimensional view of the packing box of FIG. 2A when the cover body is closed to the box body. Referring to FIG. 2A and FIG. 3, when the top plate 20 of the cover body 120 is flipped towards the inner surface 10*a* of the bottom plate 10 of the box body 110 to contact one side of each of the first side plates 111, 112, 113 located away from the bottom plate 10, the second side plates 121, 122, 123 of the cover body 120 respectively contact the second outer layers 111*a*, 112*a*, 113*a* of the first side plates 111, 112, 113 of the box body 110 through the first inner layers 121*b*, 122*b*, 123*b*. In this case, the packing box 100 presents a close state shown in FIG. 3.

FIG. 4A to FIG. 4D are cross-sectional views of a closing process of the cover body of the packing box of FIG. 2A along a section line A-A'. Referring to FIG. 4A to FIG. 4D, during the process or closing the cover body 120 to the box body 110, the first tongue piece 116 of the first side plate 111 is pushed by the first inner layer 121*b* of the second side plate 121, and the free end 116*b* of the first tongue piece 116 is gradually approached to the outer surface 117*b* of the first side plate 111 until the free end 116*b* of the first tongue piece 116 moves into the notch 125 and is rebounded back to the inner surface 127*a* of the first outer layer 121*a* of the second side plate 121 to make a sound. It should be noted that in the present embodiment, the first inner layer 121*b* of the second side plate 121 has the second tongue piece 126 upwarped towards the inner surface 127*a* of the first inner layer 121*b*. Therefore, during the process of closing the cover body to the box body 110, compared to the situation that the first tongue piece 116 is pushed by the planar first inner layer 121*b* of the second side plate 121, the first tongue piece 116 pushed by the upwarped second tongue piece 126 of the first inner layer 121*b* makes the free end 116*b* of the first tongue piece 116 to be more closer to the outer surface 117*b* of the first side plate 111, such that when the free end 116*b* of the first tongue piece 116 moves into the notch 125, the freed end 116*b* may strike the inner surface 127*a* of the first outer layer 121*a* of the second side plate 121 from a position P1 in a larger rebound force to make a larger sound.

Figure 5A:
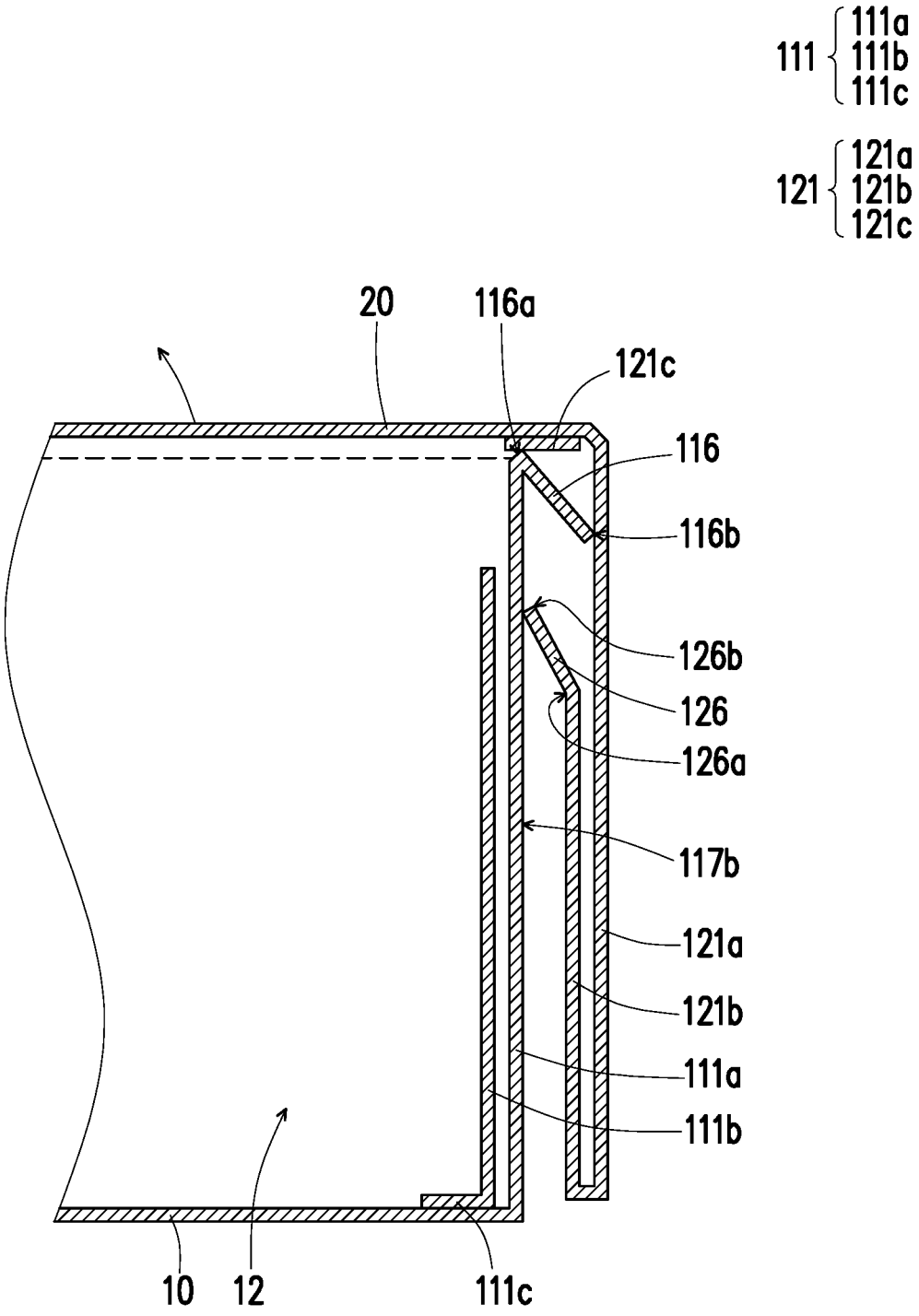
FIG. 5A to FIG. 5F are cross-sectional views of an opening process of the cover body of the packing box of FIG. 2A along a section line A-A'.
Figure 5B:
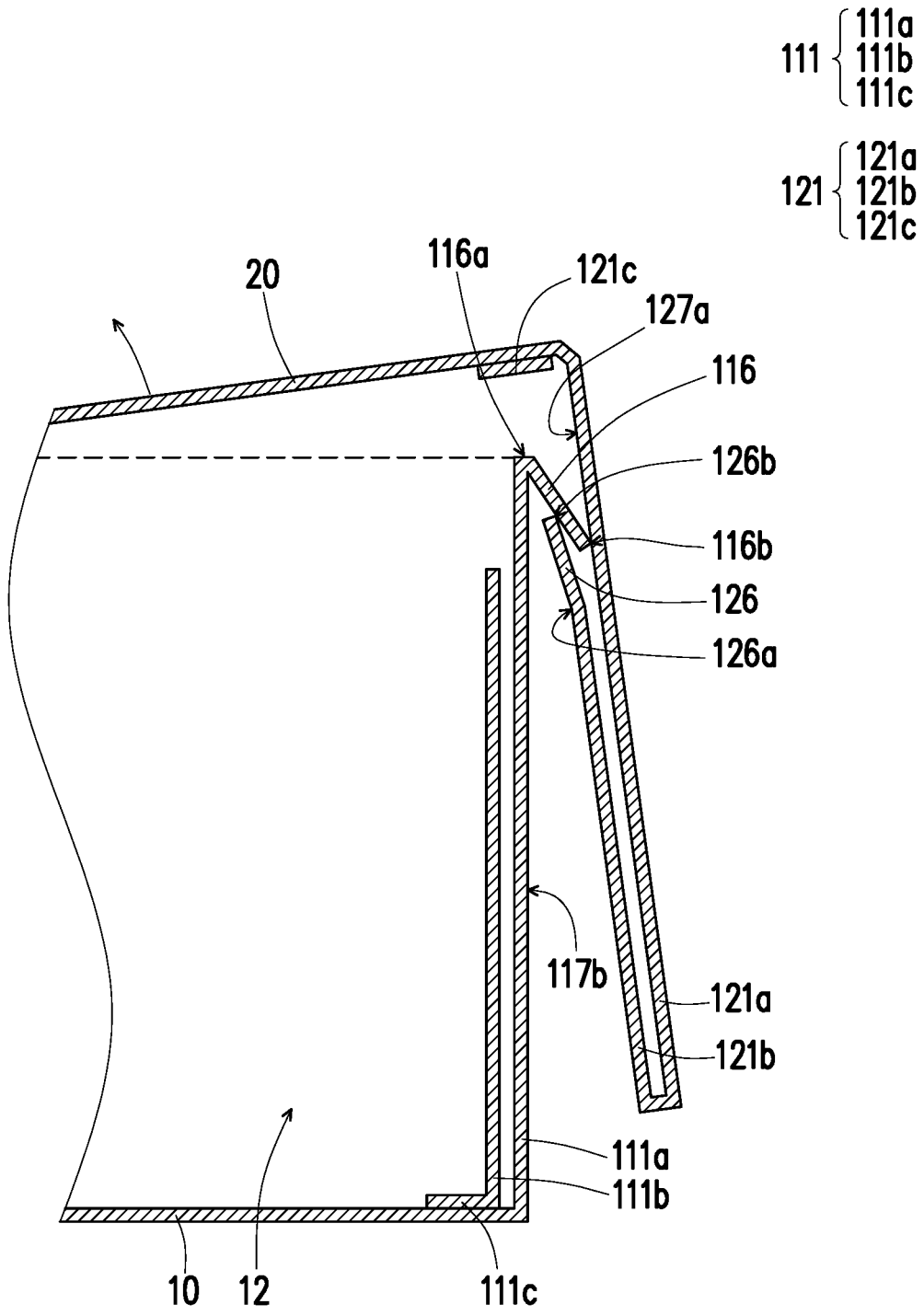
Figure 5C:
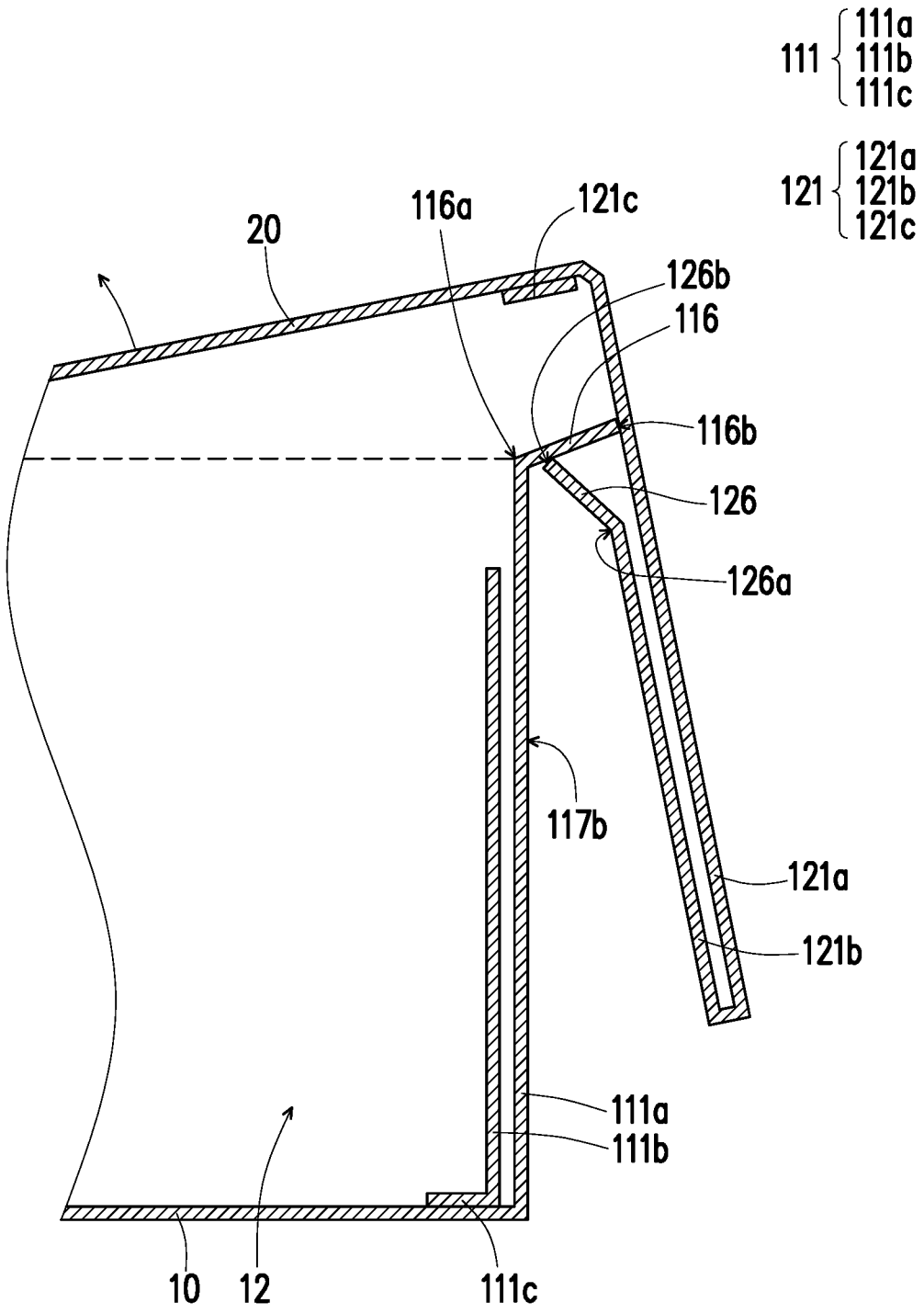
Figure 5D:
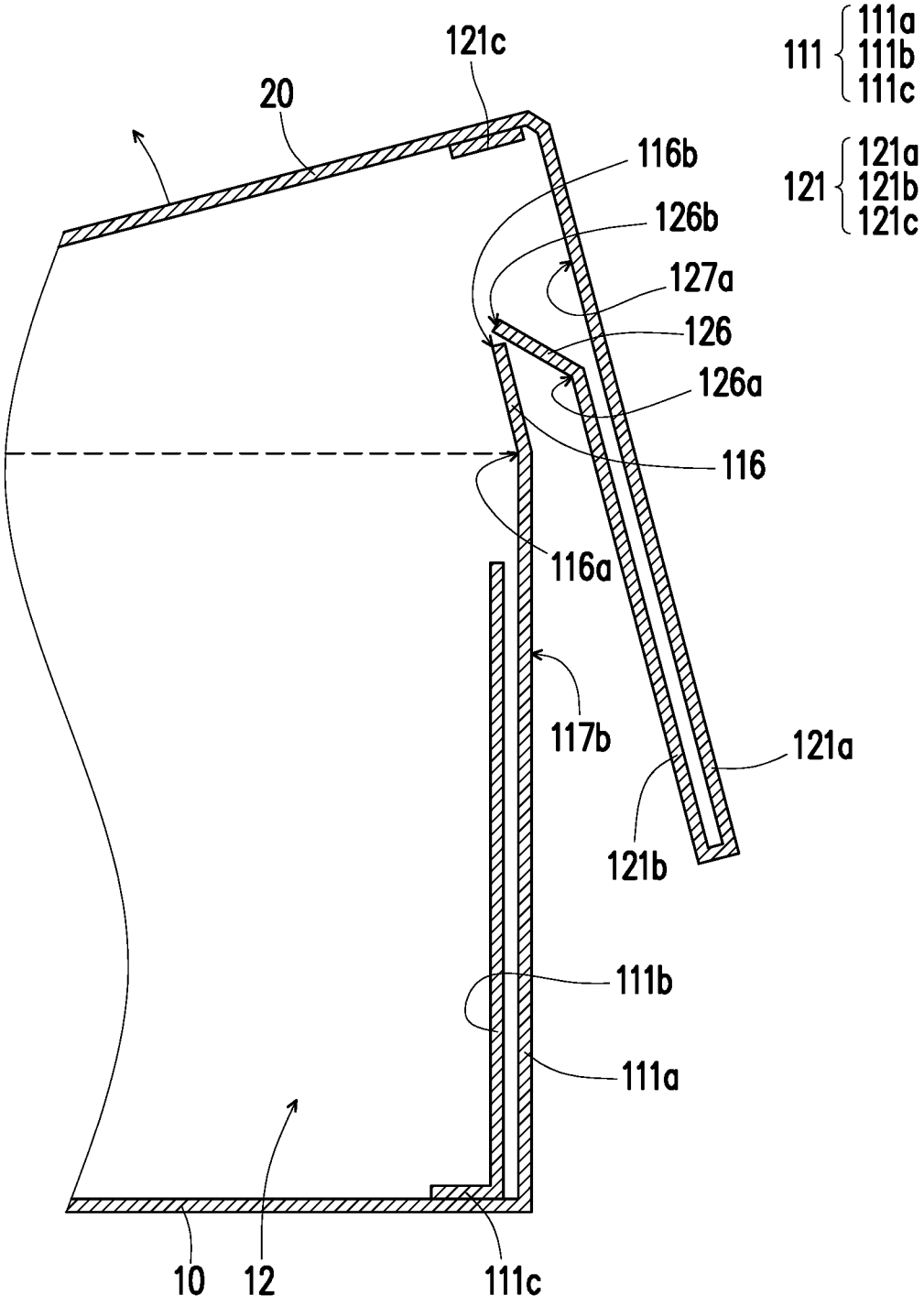
Figure 5E:
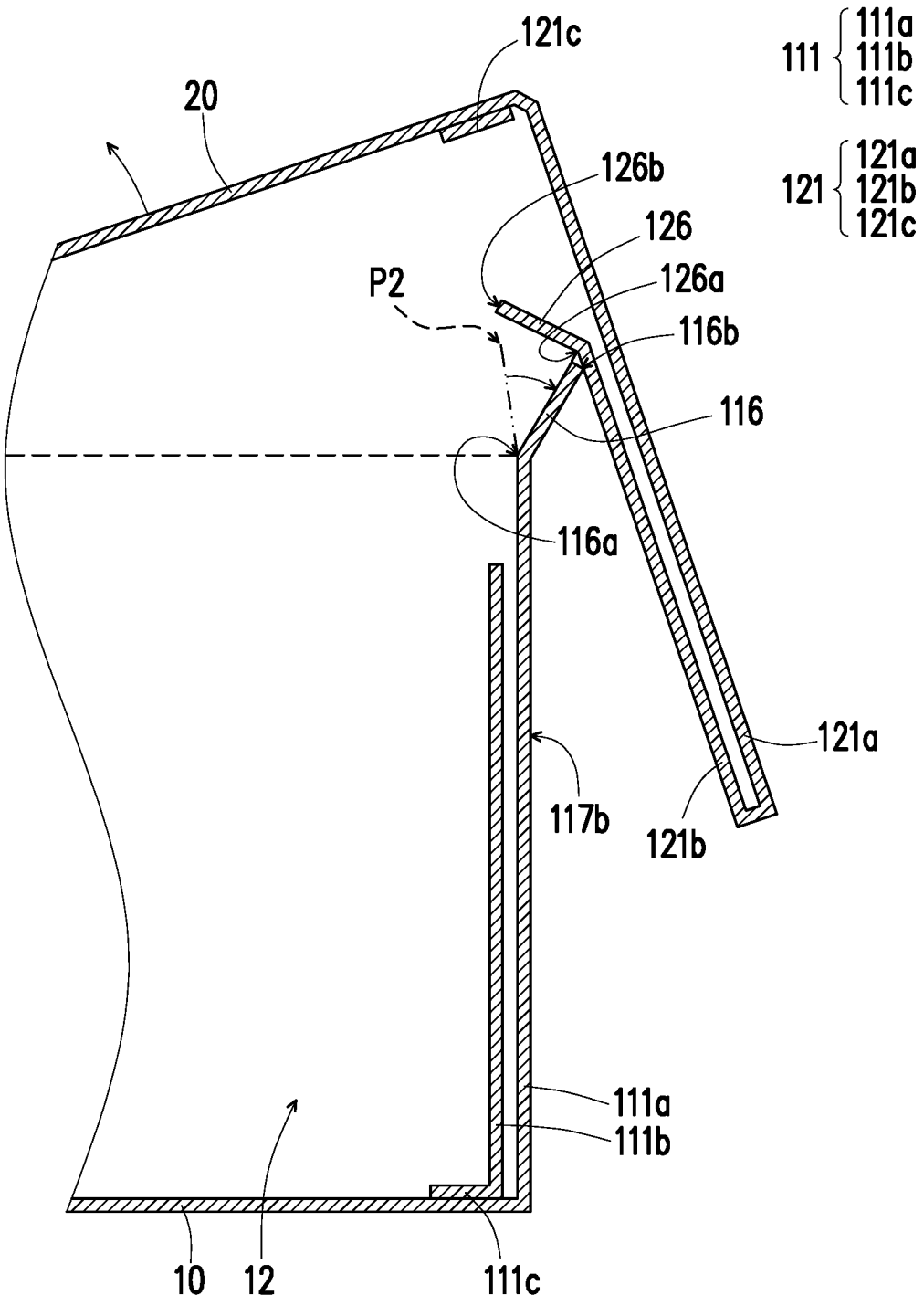
Figure 5F:
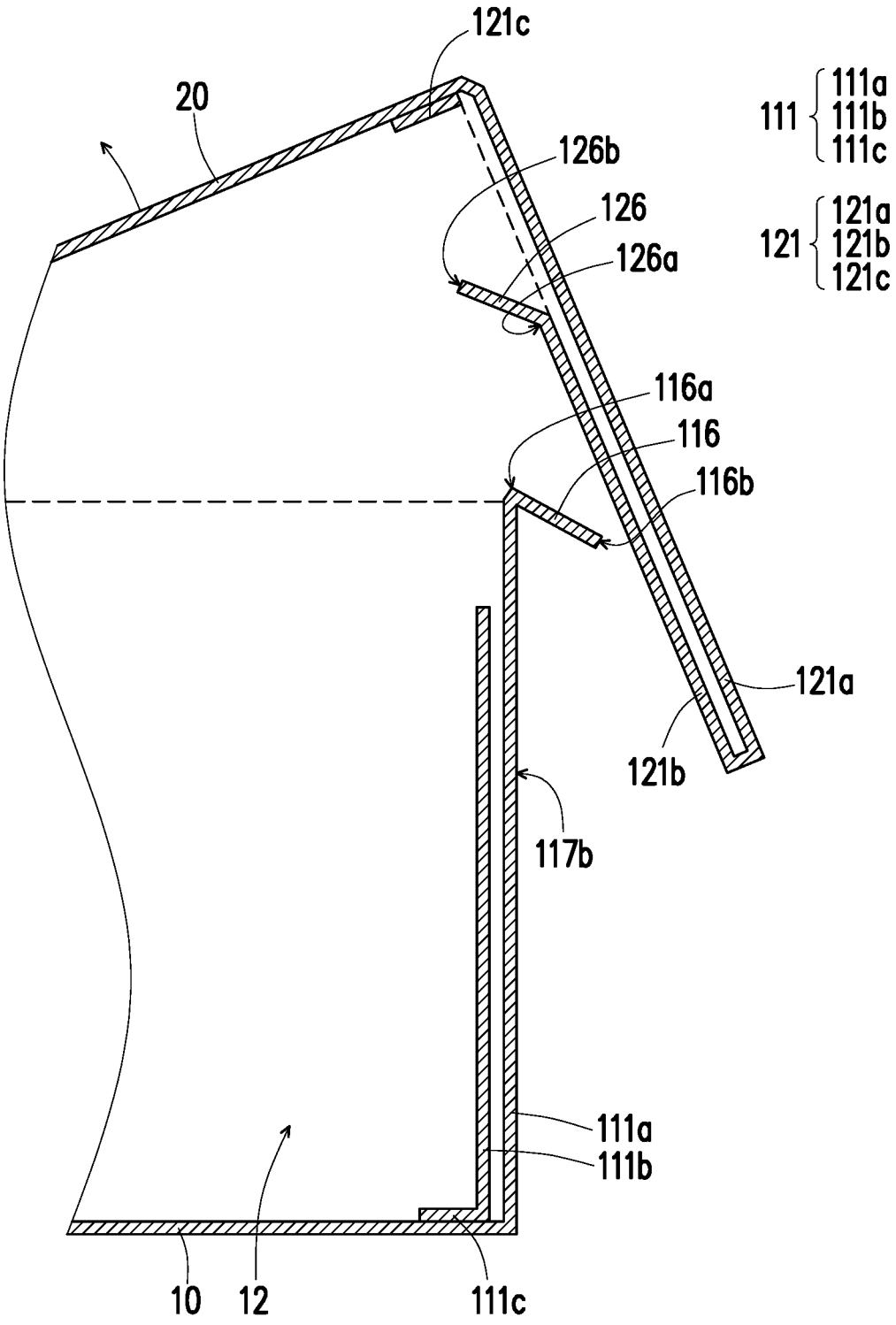

FIG. 5A to FIG. 5F are cross-sectional views of an opening process of the cover body of the packing box of FIG. 2A along a section line A-A'. Referring to FIG. 5A and FIG. 5B, in a first phase that the cover body 120 of the packing box 100 is lifted up from the box body 110, the free end 116*b* of the first tongue piece 116 of the first side plate 111 moves into the space between the second tongue piece 126 and the first outer layer 121*a*, and the first tongue piece 116 contacts and interferes with the second tongue piece 126. Referring to FIG. 5C to FIG. 5F, in a second phase that the cover body 120 of the packing box 100 is lifted up from the box body 110, the second tongue piece 126 is folded in a direction away from the first outer layer 121*a*, and drives the free end 116*b* of the first tongue piece 116 to rotate in a direction away from the outer surface 117*b* of the first side plate 111 until leaving a moving path of the second tongue piece, so as to release the interference on the second tongue piece 126. Referring to FIG. 5D and FIG. 5E, it should be noted that when the first tongue piece 116 releases the interference on the second tongue piece 126, the first tongue piece 116 rotates in a direction from a position P2 towards the outer surface 117*b* of the first side plate 111 and strikes the inner surface 127*a* of the first inner layer 121*b* of the second side plate 121 in a rebound force to produce a sound. Therefore, a user may learn that the cover body 120 of the packing box 100 is separated from the box body 110 through the produced sound.

It should be noted that in the embodiment, if the box body 110 of the packing box 100 is not filled with goods or is not configured with the inner separation member 200 (referring to FIG. 2B), during the process of lifting the cover body 120 from the box body 110, even if the first inner layer 121*b* is not configured with the second tongue piece 126, the first side plate 111 having the first tongue piece 116 may be slightly deformed inward to release the interference between the first tongue piece 116 and the first inner layer 121*b*, so as to smoothly lift the cover body 120.

Moreover, although in the second phase that the cover body 120 of the packing box 100 is lifted up from the box body 110, a flipping angle the first tongue piece 116 is larger than that of the second tongue piece 126, in other embodiments, the flipping angle of the second tongue piece 126 may be greater than that of the first tongue piece 116. In the embodiment that the flipping angle of the second tongue piece 126 is greater than that of the first tongue piece 116, when the inner separation member 200 (shown in FIG. 2B) is disposed in the box body 110 of the packing box 100, the inner separation member 200 may lean against the first side plate 111 having the first tongue piece 116. The inner side of the first side plate 111 is not easy to be deflected inward (deformed towards the accommodation space 12) due to support of the inner separation member 200. Therefore, during the process of lifting up the cover body 120 from the box body 110, the second tongue piece 126 may have a large angle folding to leave the moving path of the first tongue piece 116, so that the cover body 120 may be smoothly lifted up.

In summary, in the packing box of the embodiment of the invention, the first side plate of the box body is configured with the first tongue piece, the second side plate of the cover body has the inner layer and the outer layer stacked with each other, and the inner layer is configured with the notch corresponding to the first tongue piece. During the process of closing the cover body to the box body, the first tongue piece is first pushed by the inner layer and slightly deformed, and is then moved into the notch of the inner layer and rebounded back, such that the free end strikes the part of the outer layer of the second side plate of the cover body corresponding to the notch. Since the first tongue piece is first pushed and deformed and is then rebounded back, when the first tongue piece of the box body is rebounded back to strike the cover body, a loud sound is produced, such that the user learns that the cover body has completed closing. The above sound made by the first tongue piece is similar to a sound produced by a buckling member when it is buckled. Namely, the packing box of the embodiments of the invention is unnecessary to install a buckling member but still has the quality similar to the existing packing box using the buckling member. Moreover, the second tongue piece is selectively configured beside the notch of the first inner layer, and during the process of closing the cover body to the box body, the free end of the first tongue piece pushed by the upwarped second tongue piece may be more deformed, such that when the first tongue piece enters the notch of the inner layer, the first tongue piece may strike the cover body in a larger rebound force to make a louder sound, and/or during the process of lifting up the cover body from the box body, second tongue piece disposed beside the notch of the first inner layer may be flipped in large angle to facilitate retreat of the first tongue piece. It should be noted that during the manufacturing process, no adhesion is required or configuration of extra buckling member is unnecessary, so that effects of simplifying a production process and reducing manufacturing cost are achieved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A packing box, comprising:

a box body, comprising a bottom plate and a plurality of first side plates connected to the bottom plate, wherein the bottom plate and the first side plates collectively encircle an accommodation space, wherein one of the first side plates comprises a first tongue piece extending out of the accommodation space, the first tongue piece comprises a fixing end and a free end opposite to each other, and the fixing end of the first tongue piece is connected to one side of the first side plate away from the bottom plate; and a cover body, comprising a top plate and a second side plate connected to the top plate, wherein the top plate is pivotally connected to the box body, such that the top plate is adapted to be opened or closed to expose or shield the accommodation space, the second side plate comprises a first inner layer and a first outer layer stacked with each other, the first inner layer has a notch, and the notch is positioned on a boundary between the second side plate and the top plate and corresponds to the first tongue piece, wherein during a process that the cover body is closed to the box body, the first tongue piece of the first side plate is pushed by the first inner layer of the second side plate, and the free end is gradually approached to an outer surface of the first side plate until the free end moves into the notch and is rebounded back to an inner surface of the first outer layer.

2. The packing box as claimed in claim 1, wherein the first inner layer of the second side plate has two slits extended from the notch, and a part of the first inner layer located between the two slits is adapted to be folded to serve as a second tongue piece.

3. The packing box as claimed in claim 2, wherein in a first phase that the cover body is lifted up from the box body, the free end of the first tongue piece of the first side plate is moved into a space between the second tongue piece and the first outer layer, and the first tongue piece contacts to interfere the second tongue piece.

4. The packing box as claimed in claim 3, wherein in a second phase that the cover body of the packing box is lifted up from the box body, the second tongue piece is folded in a direction away from the first outer layer, and drives the free end of the first tongue piece to rotate in a direction away from the outer surface of the first side plate until leaving a moving path of the second tongue piece, so as to release the interference on the second tongue piece.

5. The packing box as claimed in claim 2, wherein a length of each of the slits is equal to a length of the first tongue piece.

6. The packing box as claimed in claim 1, wherein a width of the first tongue piece is greater than a length of the first tongue piece.

7. The packing box as claimed in claim 1, wherein dimensions of a length and a width of the notch are greater than or equal to dimensions of a length and a width of the first tongue piece, respectively.

8. The packing box as claimed in claim 1, wherein the first side plate having the first tongue piece comprises a second inner layer and a second outer layer stacked with each other, the second inner layer has a U-shape slit, and the first tongue piece is formed by folding a part of the second inner layer surrounded by the U-shape slit towards an outer surface of the second outer layer.

9. The packing box as claimed in claim 1, wherein a shape of the notch corresponds to a shape of the first tongue piece.

10. The packing box as claimed in claim 1, further comprising:

an inner separation member, disposed in the accommodation space, and leaning against the first side plate having the first tongue piece.

* * * * *